US009848677B2

(12) United States Patent
Sayed

(10) Patent No.: US 9,848,677 B2
(45) Date of Patent: Dec. 26, 2017

(54) JEWELRY CLASP

(71) Applicant: Haider Sayed, Forest Hills, NY (US)

(72) Inventor: Haider Sayed, Forest Hills, NY (US)

( * ) Notice: Subject to any disclaimer, the term of this patent is extended or adjusted under 35 U.S.C. 154(b) by 0 days.

(21) Appl. No.: 15/243,027

(22) Filed: Aug. 22, 2016

(65) Prior Publication Data

US 2017/0332745 A1 Nov. 23, 2017

Related U.S. Application Data

(60) Provisional application No. 62/338,779, filed on May 19, 2016.

(51) Int. Cl.
*A44C 5/00* (2006.01)
*A44C 5/20* (2006.01)
*A44C 15/00* (2006.01)

(52) U.S. Cl.
CPC ..... *A44C 5/2004* (2013.01); *A44C 15/005* (2013.01)

(58) Field of Classification Search
CPC ..... A45C 5/2004; A45C 15/005; E05B 19/00; E05B 19/0005
See application file for complete search history.

(56) References Cited

U.S. PATENT DOCUMENTS 2,561,944 A * 7/1951 Oberfield ..... E05B 19/22 70/395
3,524,335 A * 8/1970 George ..... E05B 27/083 70/388
4,120,184 A * 10/1978 Gerlach ..... E05B 11/00 70/389
2002/0116968 A1* 8/2002 Shvarts ..... E05B 9/084 70/370
2014/0373581 A1* 12/2014 Uljens ..... E05B 29/0013 70/357

* cited by examiner

*Primary Examiner* — David Upchurch
(74) *Attorney, Agent, or Firm* — Lombard & Geliebter LLP; Antonio Papageorgiou, Esq.

(57) ABSTRACT

A jewelry clasp is provided that includes a key, a casing, and a locking mechanism. The casing includes an external body with an internal cavity having an opening for receiving the key and another opening into which the locking mechanism is partially disposed. The locking mechanism includes a lever and a spring. The lever has a locking end configured to engage the key in a fixed position relative to the casing, and a pressing end for disengaging the lever from the key. The spring provides tension to the lever to facilitate engagement of the key.

12 Claims, 3 Drawing Sheets

JEWELRY CLASP

The present application claims priority to U.S. Provisional Patent Application No. 62/338,779, filed May 19, 2016, which is incorporated herein by reference.

BACKGROUND OF THE INVENTION

The present application relates to jewelry clasps and more specifically to jewelry clasps using a key and lock mechanism.

For a long time, individuals with limited or reduced manual dexterity, especially seniors, have struggled with locking and unlocking clasps on necklaces, bracelets, and other jewelry. Accordingly, there is a need for a jewelry clasp that overcomes these challenges. What follows is a description of a novel mechanism for a clasp based on the concept of a lock and key of the appropriate size to be used for necklaces and bracelets. The mechanism is very easy to use, sturdy and secure.

SUMMARY OF THE INVENTION

A jewelry clasp is provided that includes a key, a casing, and a locking mechanism. The key has a bow end and a blade end, the blade end having at least one cut therein. The casing includes an external body having a top section, bottom section, and an internal cavity, where the internal cavity has a first opening and a second opening. Moreover, the first opening is configured to receive the blade end of the key. The locking mechanism may be partially disposed within the second opening of the internal cavity and the locking mechanism may include a lever and a spring. In one embodiment, the lever has a locking end, a pressing end, and a first attachment point located between the locking end and pressing end, the lever pivotally attached to the casing at the first attachment point, where the locking end is configured to engage the at least one cut in the blade end of the key, such that it holds the key in a fixed position relative to the casing, and where the pressing end is configured to disengage the engagement end from the at least one cut in the blade end of the key when an external force is applied to the pressing end. The spring may have a casing end, a lever end, and a second attachment point located between the casing end and lever end, wherein the casing end of the spring is held against the internal cavity of the casing and the lever end of the spring is held against the lever, such that the spring applies tension to the pressing end of the lever so as to cause the locking end of the lever to engage the at least one cut in the blade end of the key.

In at least one embodiment, the blade end of the key contains a recess along a length of the blade end.

In at least one embodiment, the blade end of the key has a plurality of cuts therein.

In at least one embodiment, at least one of the plurality of cuts is comparatively larger than the other cuts, and the locking end of the lever engages the larger cut in the blade end of the key.

In at least one embodiment, the larger cut is one of a U, square, and rectangular shaped.

In at least one embodiment, the bow end of the key and the external body of the casing each contain an attachment means for attaching the clasp to a wearable accessory.

In at least one embodiment, the attachment means is a jump ring.

In at least one embodiment, the internal cavity has a pre-defined shape configured to house the locking mechanism.

In at least one embodiment, the casing is semi-hollow as a result of the internal cavity having a pre-defined shape.

In at least one embodiment, the lever pivots about the first attachment point.

In at least one embodiment, the locking mechanism further comprises a securing means to attach the locking mechanism to the external body of the casing at the first and second attachment points.

In at least one embodiment, the securing means is a soldered nail.

In at least one embodiment, the external force applied to the pressing end of the lever causes a first rotational movement of the pressing end about the first attachment point and a second rotational movement of the locking end of the lever about the first attachment point in the opposite direction of the first rotational movement.

DETAILED DESCRIPTION OF THE INVENTION

The present application generally provides novel clasps for fastening items, such as jewelry.

Figure 1:
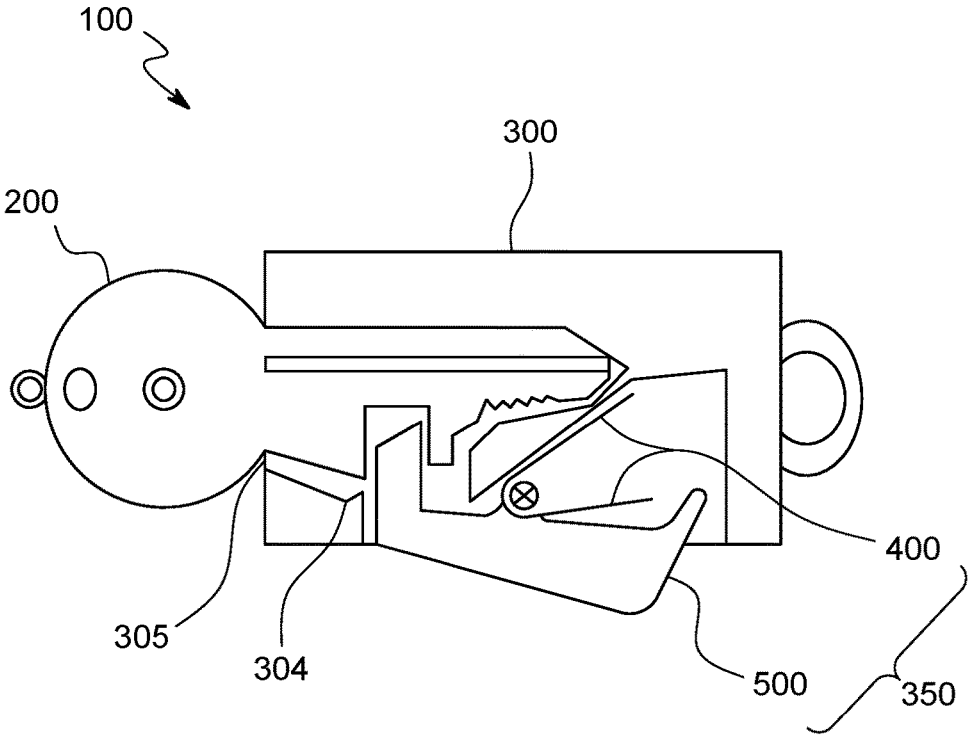
FIG. 1 is a cross-sectional view of a jewelry clasp according to one embodiment of the jewelry clasps disclosed herein.

Referring to FIG. 1, the jewelry clasp 100 includes a male element 200 and casing 300. The male element is preferably shaped as a key, hereinafter referred to simply as a key 200. The casing 300 includes an opening 305 for receiving the key 200 into a cavity 304 formed within the casing 300. A locking mechanism 350 is disposed within the cavity 304, the locking mechanism including a spring 400 and lever 500.

Figure 2:
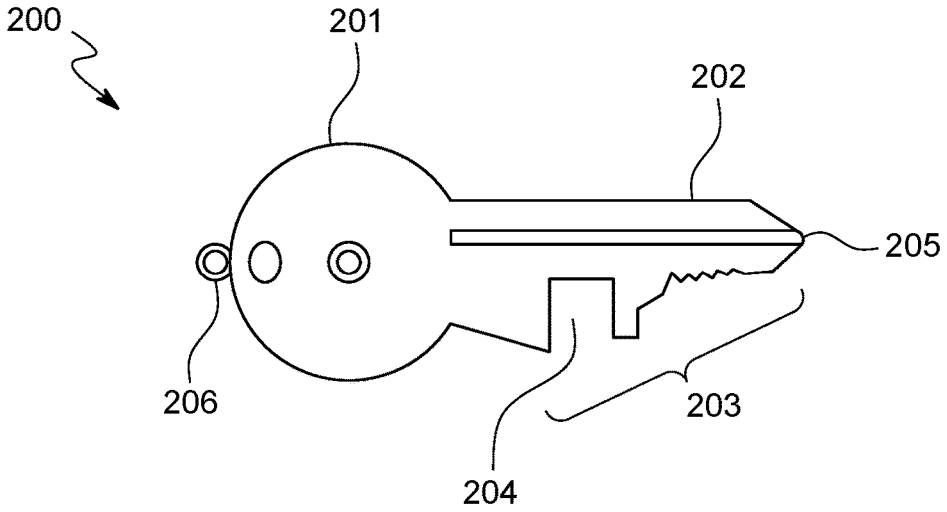
FIG. 2 is a schematic view of a key for a jewelry clasp according to at least one embodiment.

Referring to FIG. 2, the key 200 preferably has a bow end, or broad section, 201 and a blade end 202 extending laterally from the broad section 201. The blade end 202 preferably includes at least one or preferably a plurality of cuts 203 on a top end of the blade 202. In a preferred embodiment, the cut(s) 203 contain a slot cut 204 that is comparatively larger than the other cuts. The slot cut 204 is preferably U, square, and/or rectangular shaped. The blade end 202 of the key 200 preferably contains recess 205 extending laterally along the length of the blade, as shown. The recess may be U, square, and/or rectangular shaped. In a preferred embodiment, the bow end 201 of the key 200 contains an attachment means 206 for attaching the key 200 to an end of a wearable accessory. In a preferred embodiment, the attachment means 206 is a jump ring or any other device capable of attaching the key 200 to the wearable accessory.

The wearable accessory may be any item that can be worn around a body party, such as the neck or arm. In a preferred embodiment, the wearable accessory is a necklace or bracelet, but it can also be a chain, lanyard, wristband, watch, tie, scarf, collar, or other similar item.

Referring to FIGS. 1 and 5A, the casing 300 has an external body 301 that has a top section 302, bottom section 303, and an internal cavity 304 within the external body 301 of the casing 300. The internal cavity 304 is preferably of a pre-defined shape configured to house the locking mechanism 350. In a preferred embodiment, the pre-defined shape of the internal cavity 304 results in a semi-hollow casing 300. The internal cavity 304 includes at least two openings 305 and 306 at the surface where the internal cavity and external body of the casing meet. Opening 305 is configured to receive the blade end 202 of key 200, while opening 306 is configured to expose a portion of the locking mechanism. The portion of the locking mechanism extending through opening 306 protrudes from the external body 301 of casing 300.

The material of the key 200 and casing 300 is preferably metal or plastic, but may be any material capable of being hollowed to form internal cavity 304. The key 200 and casing 300 need not be the same material.

Referring to FIGS. 6A-6I, casing 300 and bow 201 of key 200 may be any one of a variety of shapes. In one embodiment, the casing and bow are disc-shaped. In another embodiment, the casing and bow are rectangular-shaped. In other embodiments, the casing and bow may be of any shape that is aesthetically pleasing, such as the shape of an object or figure.

Figure 3A:
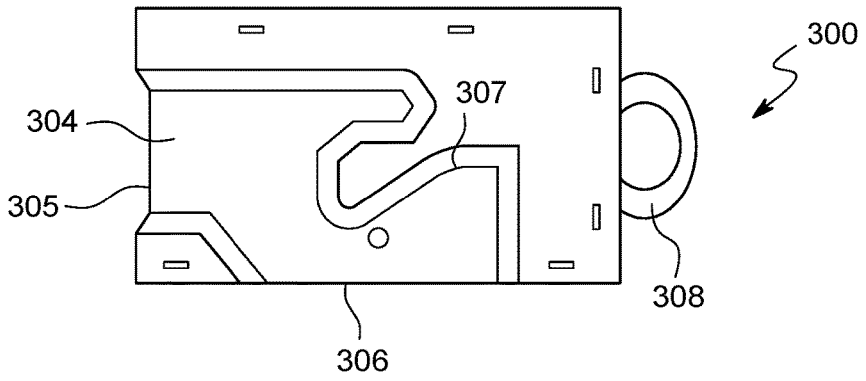
FIG. 3A is an internal cross-sectional view of a casing for a jewelry clasp according to at least one embodiment.
Figure 3B:
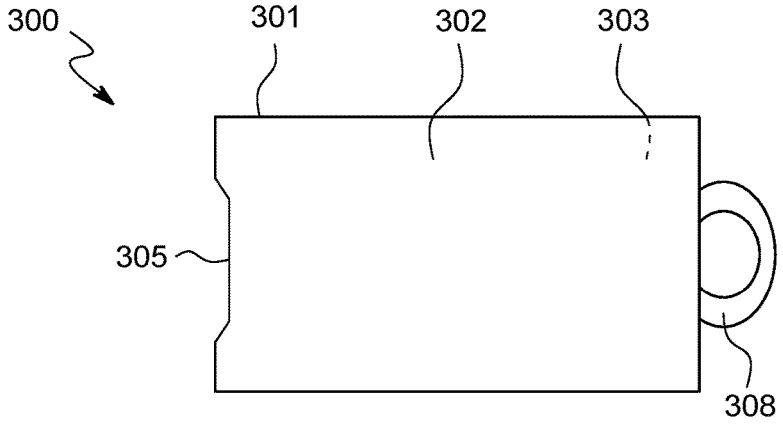
FIG. 3B is an external view of a casing for a jewelry clasp according to at least one embodiment.
Figure 4:
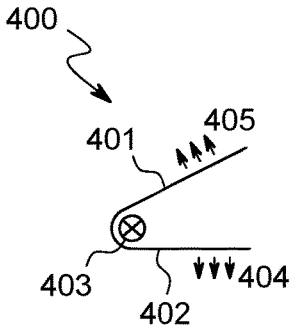
FIG. 4 is a schematic view of a spring for a jewelry clasp according to at least one embodiment.

Referring to FIGS. 1, 3 and 4, the locking mechanism includes a spring 400 and lever 500. The spring and lever work in concert to lock and unlock the jewelry clasp 100, i.e., the key 200 to the casing 300.

Referring to FIG. 4, in a preferred embodiment, spring 400 is a V-shaped spring having two legs 401 and 402 joined at a central coil 403. Leg 401 has the casing end of the spring and is held against a wall 307 of the internal cavity 304 of the semi-hollow casing 300. Leg 302 has the lever end of the spring and is held against the bottom side 507 of the pressing end 502 of the lever 500. The angle between the spring legs is capable of expansion and contraction, depending on whether a force is applied to the spring legs. While the preferred embodiment is the spring described herein, the spring may be any device or mechanism capable of creating forces with a central point that remains in a fixed position.

Figure 5:
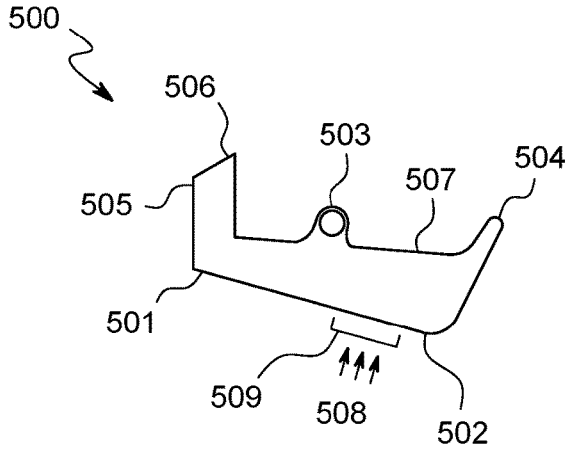
FIG. 5 is a schematic view of a lever for a jewelry clasp according to at least one embodiment.
Figure 6A:
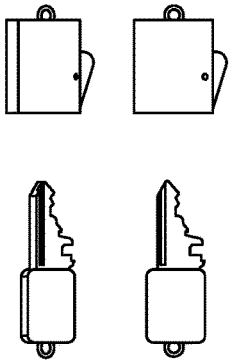
FIGS. 6A-6I are perspective views of several embodiments of a jewelry clasp.
Figure 6B:
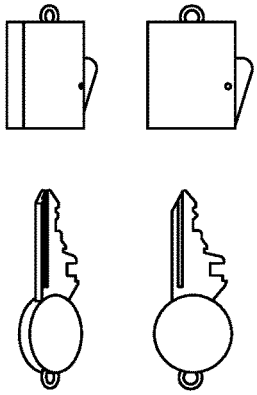
Figure 6C:
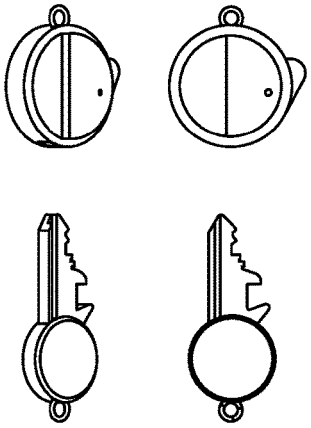
Figure 6D:
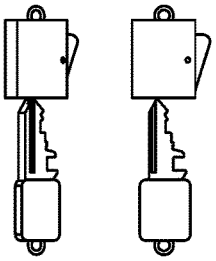
Figure 6E:
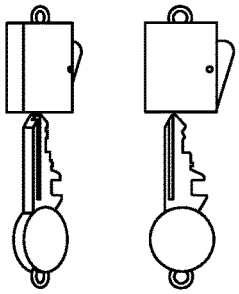
Figure 6F:
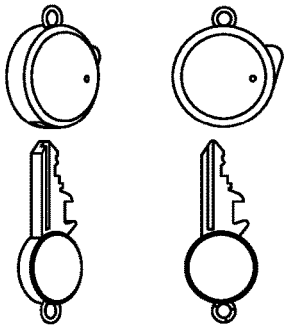
Figure 6G:
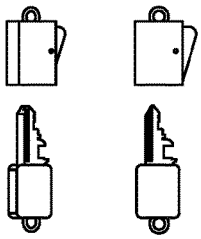
Figure 6H:
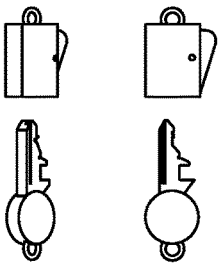
Figure 6I:
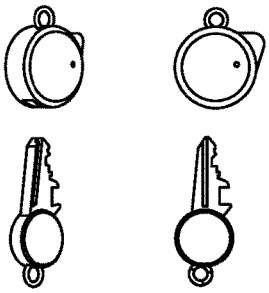

Referring to FIG. 5, lever 500 comprises a locking end 501, a pressing end 502, and an attachment point 503 located between the locking end and pressing end. Locking end 501 is configured to engage the key 200 and lock it in place relative to the casing 300. In a preferred embodiment, locking end 501 is configured to engage at least one of the plurality of cuts 203 in the blade 202 of the key 200—preferably the slot cut 204—such that it holds the key in a fixed position relative to the casing. In a preferred embodiment, locking end 501 contains a tip 505 comprising a plurality of cuts 506. The cuts are configured such that when the key 200 is inserted into the casing 300, the cuts 506 of the locking end 501 of the lever 500 slide along the cuts 203 of the key 200, until lever engages the slot cut 204 of the key.

In one embodiment, the cuts 203 in the key are such that the thickness of the blade end 202 at the peaks of the cuts increases toward the bow end 201 of the key 200, forming a ramp that increases toward the rear of the key, which results in an increase in the tension in the spring 400 as the key 200 is inserted into the casing 300. The cuts in the key and the lever may provide one or a plurality of intermediate/redundant locking points. Once the key is inserted beyond the high point on the ramp, the locking end 501 of the lever 500 engages the slot cut 204 to lock the key and casing together. The spring provides a bias force that keeps the lever engaged with the slot cut 204.

The pressing end 502 of the lever has a pressing side 509 upon which an external force 508 may be applied. The external force 508 is preferably the force applied by a user's finger but any force may suffice. The pressing end 502 also has a bottom side 507 opposite from the pressing side 509, against which the lever end of the spring 402 is held. The lever end of the spring applies a spring force 404 against the bottom side 507 of the pressing end of the lever.

In a preferred embodiment, the pressing end 502 may also contain a stop leg 504, which limits the depth by which the pressing end 502 of the lever may travel into the casing 300 when an external force 508 is applied. In a preferred embodiment, the pressing end of the level will not travel further than the surface of opening 306.

In a preferred embodiment, the locking mechanism 350 is attached to the casing 301 such that the locking mechanism is partially disposed within opening 306 of the internal cavity 304, such that the pressing end 502 of the lever 500 is exposed outside the body of the casing.

The locking mechanism 350 is attached to the body 301 of the casing 300 using an attachment means 600 at the attachment point 503 of the lever 500 and the coil 403 of the spring 400. The coil of the spring serves as the attachment point for the spring in addition to providing spring force. In a preferred embodiment, the attachment point 503 of the lever 500 and the coil 403 of the spring 400 are secured against the cavity by means of a nail, which is soldered to the top 302 and/or bottom 303 sections of the casing 300. Any attachment means may suffice in place of a nail.

The attachment point 503 serves as a point about which the lever 500 pivots. A rotational movement of the pressing end 502 of the lever 500 about the pivot point results in rotational movement by the locking end 501 of the lever in the opposite direction.

In operation, the lever and spring work in concert to hold the key in a fixed position when no external force is applied to the lever, and to release the key when force is applied to the lever.

The jewelry clasp is locked in the following manner. Generally, the key is engaged with the casing and the lever locks the key in place. Specifically, the key 200 is grasped at the bow end 201 by the user and the blade end 202 is inserted into hole 305 of the casing. Alternatively, an external force causes the key to be inserted into the casing. As the key is inserted, the cuts 506 on the locking end 501 of the lever 500 slide along the cuts 203 of the key 200, then engage the slot cut 204 of the key. Simultaneously, the spring 400, in its resting state, applies forces 404 and 405 against the wall 307 of the internal cavity 304 and the bottom side 507 of the pressing end 502 of the lever 500, respectively, so as to cause the locking end 501 of the lever to engage slot 204, causing the key to remain in a fixed position and locking in place. When no external force is applied to the pressing end of the lever, the spring force causes the lever to remain in a fixed position.

The jewelry clasp is unlocked in the following manner. Generally, the lever is pressed, causing the key to release from the casing. Specifically, a user applies an external force 508 to the pressing end 502 of the lever. The external force on the pressing end causes the lever 500 to pivot around the attachment point 503, causing the locking end 501 of the lever to release, or disengage, from the slot cut 204 of the key 200. The user grasps the key 200 at the bow end 201 and removes it from the casing. Alternatively, an external force causes the key to be removed from the casing.

It will be understood that there are numerous modifications of the illustrated embodiments described above which will be readily apparent to one skilled in the art, including any other combinations of features disclosed herein that are individually disclosed or claimed herein, explicitly including additional combinations of such features. These modifications and/or combinations fall within the art to which this invention relates and are intended to be within the scope of the claims, which follow. It is noted, as is conventional, the use of a singular element in a claim is intended to cover one or more of such an element.

While the foregoing invention has been described in some detail for purposes of clarity and understanding, it will be appreciated by one skilled in the art, from a reading of the disclosure, that various changes in form and detail can be made without departing from the true scope of the invention.

The invention claimed is:

1. A clasp comprising:

a key having a bow end and a blade end, the blade end having at least one cut therein;

a casing comprising an external body having a top section, bottom section, and an internal cavity, wherein the internal cavity has a first opening and a second opening, wherein the first opening is configured to receive the blade end of the key; and a locking mechanism partially disposed within the second opening of the internal cavity, the locking mechanism comprising:

a lever having a locking end, a pressing end, and a first attachment point located between the locking end and pressing end, the lever pivotally attached to the casing at the first attachment point, wherein the locking end is configured to engage the at least one cut in the blade end of the key, such that it holds the key in a fixed position relative to the casing;

wherein the pressing end is configured to disengage the engagement end from the at least one cut in the blade end of the key when an external force is applied to the pressing end; and a spring having a casing end, a lever end, and a second attachment point located between the casing end and lever end;

wherein the casing end of the spring is held against the internal cavity of the casing and the lever end of the spring is held against the lever, such that the spring applies tension to the pressing end of the lever so as to cause the locking end of the lever to engage the at least one cut in the blade end of the key;

and in which the bow end of the key and the external body of the casing each contain an attachment means for attaching the clasp to a wearable accessory.

2. The clasp of claim 1, in which the blade end of the key contains a recess along a length of the blade end.

3. The clasp of claim 1, in which the blade end of the key has a plurality of cuts therein.

4. The clasp of claim 3, in which at least one of the plurality of cuts is comparatively larger than the other cuts, and wherein the locking end of the lever engages the larger cut in the blade end of the key.

5. The clasp of claim 4, in which the larger cut is one of a U, square, and rectangular shaped.

6. The clasp of claim 1, in which the attachment means is a jump ring.

7. The clasp of claim 1, in which the internal cavity has a pre-defined shape configured to house the locking mechanism.

8. The clasp of claim 7, in which the casing is semi-hollow as a result of the internal cavity having a pre-defined shape.

9. The clasp of claim 1, in which the lever pivots about the first attachment point.

10. The clasp of claim 1, in which the locking mechanism further comprises a securing means to attach the locking mechanism to the external body of the casing at the first and second attachment points.

11. The clasp of claim 10, in which the securing means is a soldered nail.

12. The clasp of claim 1, in which the external force applied to the pressing end of the lever causes a first rotational movement of the pressing end about the first attachment point and a second rotational movement of the locking end of the lever about the first attachment point in the opposite direction of the first rotational movement.

* * * * *